United States Patent [19]

Armstrong

[11] 3,946,459

[45] Mar. 30, 1976

[54] SELF-PROPELLED PIPE CLEANER

[75] Inventor: Jack W. Armstrong, Baldwinsville, N.Y.

[73] Assignee: Lipe Rollway Corporation, Syracuse, N.Y.

[22] Filed: July 19, 1974

[21] Appl. No.: 490,047

[52] U.S. Cl. ..... 15/377; 15/104.2; 15/395

[51] Int. Cl.[2] ..... B08B 9/02

[58] Field of Search..... 15/104.05, 104.09, 104.16, 15/104.2, 104.3 R, 377, 395; 118/DIG. 10

[56] References Cited

UNITED STATES PATENTS

| | | | |
|---|---|---|---|
| 2,917,762 | 12/1959 | Xenis | 15/104.05 |
| 3,144,240 | 8/1964 | Connell | 15/104.05 X |
| 3,446,666 | 5/1969 | Bodine | 15/104.16 X |

*Primary Examiner*—Edward L. Roberts

*Attorney, Agent, or Firm*—Stonebraker, Shepard & Stephens

[57] ABSTRACT

A self-propelled pipe cleaner uses a body shaped to conform to the inside of a pipe with the axial extent of the body covered with a bristle pile material extending outward from the body to engage the inside of the pipe. The pile has resilient bristles uniformly inclined rearwardly relative to a forward direction of motion of the body. A vibrator is mounted within the body and energized for vibrating the body reciprocally and axially so the bristles engaging the inside of the pipe move the cleaner forward through the pipe for cleaning the pipe.

7 Claims, 10 Drawing Figures

SELF-PROPELLED PIPE CLEANER

Cleaning the insides of pipes has long been a problem, and many suggestions have been proposed. However, there remains a need for a self-propelled cleaner that can enter one end of a pipe and travel for a considerable distance while cleaning the inside of the pipe, and the invention involves recognition of a simple, low-cost, and efficient way that this can be done. The invention aims at economy, reliability, and practical effectiveness in a simple pipe cleaner that is self-propelled to travel through and clean lengths of pipe in a wide variety of circumstances.

SUMMARY OF THE INVENTION

The inventive self-propelled pipe cleaner has a body with an axial extent shaped to conform to the inside of a pipe and to have a predetermined uniform clearance around the inside of the pipe. Pile material substantially covers the axial extent of the body and extends outward from the body far enough to engage the inside of the pipe, and the pile material has resilient bristles of uniform length uniformly inclined from a plane transversely perpendicular to the axial extent of the body rearwardly relative to a forward direction of motion of the cleaner. A vibrator is mounted within the body and is energized reciprocally and axially so the bristles engaging the inside of the pipe move the cleaner forward through the pipe for cleaning the pipe.

DRAWINGS

DETAILED DESCRIPTION

Figure 1:
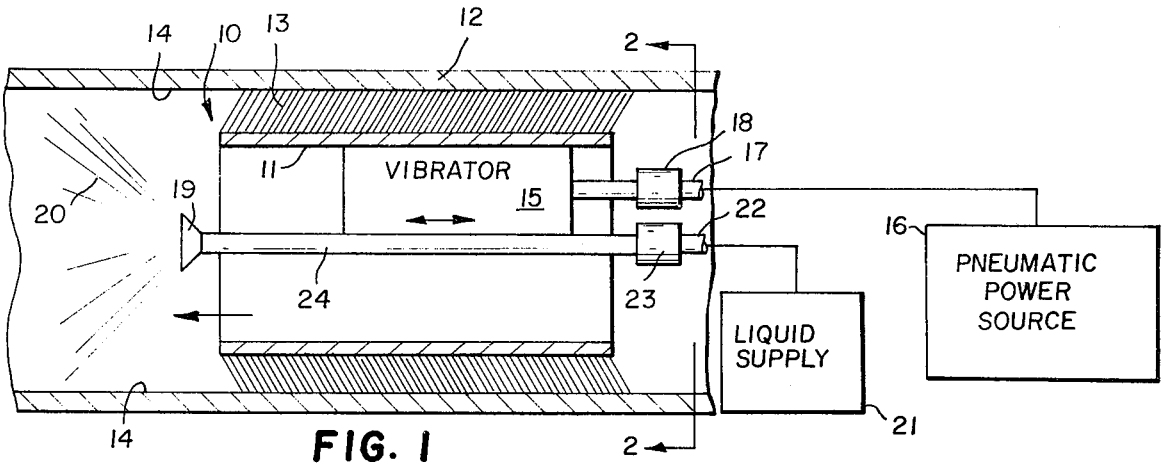
FIG. 1 is a partially schematic, longitudinal axial crosssectional view of a preferred embodiment of the inventive cleaner in a pipe.
Figure 2:
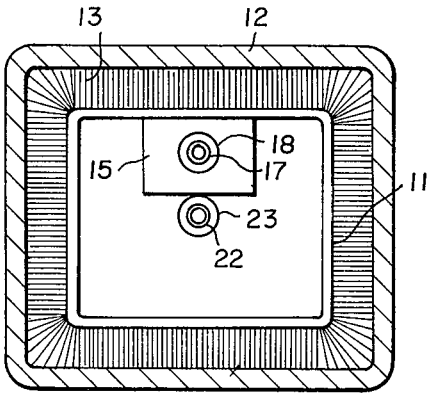
FIG. 2 is a cross-sectional view of the cleaner of FIG. 1 taken along the line 2—2 thereof.

As shown in FIGS. 1 and 2, cleaner 10 has a body 11 that is generally square in cross section to conform to the inside of generally square cross-sectioned pipe 12 with a uniform clearance around the inside of pipe 12. Body 11 extends axially inside of pipe 12, and the axial extent of body 11 is covered with a bristle pile material 13. Pile bristles 13 are resilient and extend outward from body 11 far enough to engage the inside surface

14 of pipe 12. Bristles 13 are uniform in length and are uniformly inclined from a plane transversely perpendicular to the axial extent of body 11 rearwardly relative to a forward direction of motion of body 11 as indicated by the arrow.

A vibrator 15 is mounted in body 11 and vibrates reciprocally in the direction of the axial extent of body 11 as indicated by the arrow, and as preferred for best operation. Vibrator 15 is pneumatically powered from a pneumatic power source 16 outside of pipe 12 through a flexible conduit 17 coupled to vibrator 15 through a preferably quick release coupling 18. A liquid spray nozzle 19 is also mounted on body 11 and is arranged for directing a liquid spray 20 against the inside surface 14 of pipe 12. Cleaning liquid from a liquid supply 21 outside of pipe 12 is fed through a flexible conduit 22 joined by a coupling 23 to a pipe 24 leading to nozzle 19.

The inclination of pile bristles 13 cooperates with the motion of vibrator 15 to drive body 11 forward in pipe 12 so that cleaner 10 can travel as far as pipe 12 and flexible conduits 17 and 22 will allow. As cleaner 10 advances, spray 20 cleans the inside surface 14 of pipe 12, and pile bristles 13 help by brushing and abrading inside surface 14. A nozzle 19 can be on either or both ends of body 11 so that a liquid spray 20 can precede or follow the brushing action of bristles 13. Many different liquids can be used for spray 20, including cleaning fluids, acids, surfactants, lubricants, etc. Cleaner 10 can pass through pipe 12 once with a first liquid spray 20 and again with another liquid spray 20, and different liquids can be sprayed from different nozzles mounted on body 11 in a single passage through pipe 12.

Bristles 13 can include abrasive material formed within bristles 13 so as to abrade and scrub inside surface 14 as cleaner 10 advances. Bristles 13 can be formed of resilient resin material of various types and can have various lengths and thicknesses, and can also be formed of metallic wire. Bristles 13 can also be inclined at various angles, but a 5° to 25° inclination is preferred.

Vibrator 15 can be made in different ways and can be powered other than pneumatically, and electric and hydraulic drives for vibrator 15 can be used. Also, batteries within body 11 can supply energy for powering vibrator 15 to eliminate the need for flexible conduit 17 if desired.

Figure 3:
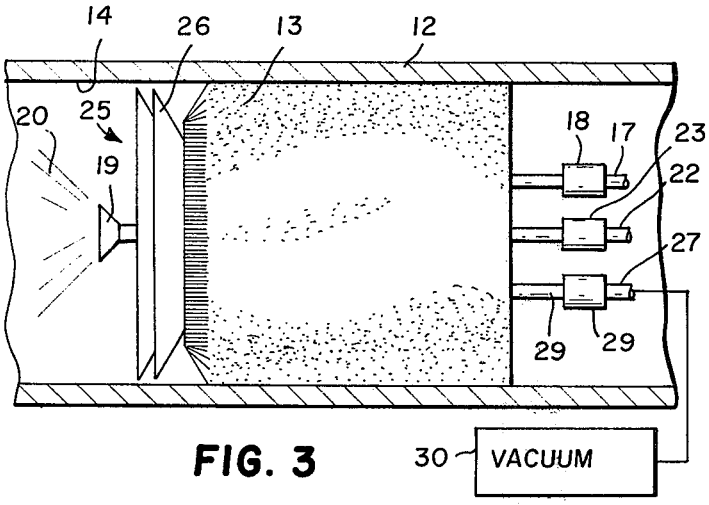
FIG. 3 is a partially schematic, longitudinal axial cross-sectional view of another preferred embodiment of the inventive cleaner.

Cleaner 25 of FIG. 3 is similar to cleaner 10 in having bristle pile 13 fitting within pipe 12 and a nozzle 19 directing a liquid spray 20 against the inside surface 14 of pipe 12. Cleaner 25 differs from cleaner 10 in adding a vacuum nozzle 26 and a vacuum line 27 connected by a coupling 28 to a pipe 29 leading to nozzle 26 so that when a vacuum device 30 outside of pipe 12 is turned on, conduit 27 and pipe 29 are evacuated to draw air, liquid, and dirt into nozzle 26 as cleaner 25 advances. Vacuum nozzle 26 can also be arranged at the rearward end of cleaner 25 and can be used with or without a spray nozzle 19.

Figure 4:
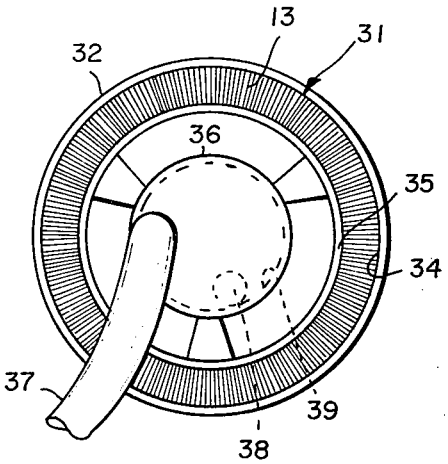
FIG. 4 is a partially schematic, end-elevational view of another preferred embodiment of the inventive cleaner in a pipe.
Figure 5:
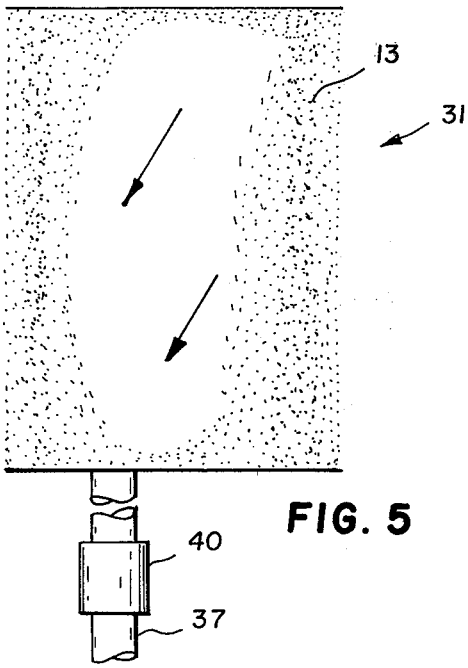
FIG. 5 is a partially schematic, plan view of the cleaner of FIG. 4 removed from the pipe.

The inventive cleaner can be shaped to fit any cross-sectional shape of pipe, and cleaner 31 as shown in FIGS. 4 and 5 is generally cylindrical to fit a cylindrical pipe 32 with pile bristles 13 engaging the inside surface 34 of pipe 32. The body 35 of cleaner 31 is also generally cylindrical and carries a vibrator 36 that is pneumatically powered through a flexible line 37 for driving a ball 38 around an internal channel 39 so that ball 38 is an unbalanced rotary element driving vibrator 36 in a rotary pattern. The reaction effect of the unbalanced rotor 38 drives body 35 in a rotary pattern in a plane transversely perpendicular to body 35 and pipe 32 to flex pile bristles 13 against the inside surface 34 of pipe 32 repeatedly and cause the desired forward motion of cleaner 31. An unbalanced rotary wheel or arm can also be used, and an unbalanced rotor can be electrically driven. There are many ways a vibrator can be arranged to drive body 31 in a rotary orbit within pipe 32 to flex pile bristles 13 and advance cleaner 31, and many different pipes including gun barrels that can be cleaned with the inventive cleaner.

As shown in FIG. 5, pile bristles 13 can be angled relative to the axial extent of cleaner 31 as indicated by the arrows so that cleaner 31 rotates as it advances inside of pipe 32. This requires a rotatable coupling 40 joining flexible line 37 to cleaner 31. A rotational advance of cleaner 31 helps brush and clean the inside 34 of pipe 32 evenly and can be advantageously combined with abrasive material in bristles 13.

Figure 6:
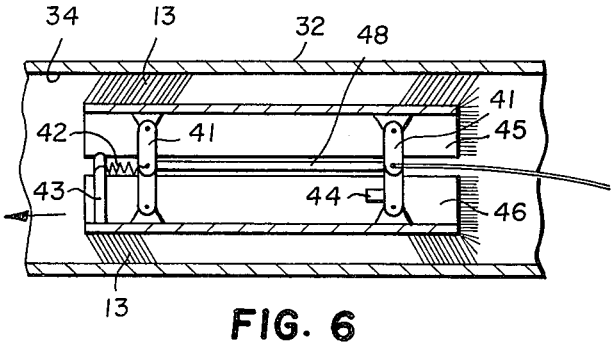
FIGS. 6 and 7 are partially schematic, longitudinal axial cross-sectional views of another preferred embodiment of the inventive cleaner shown as expanded to operating position in FIG. 6 and collapsed for rearward withdrawal in FIG. 7.
Figure 7:
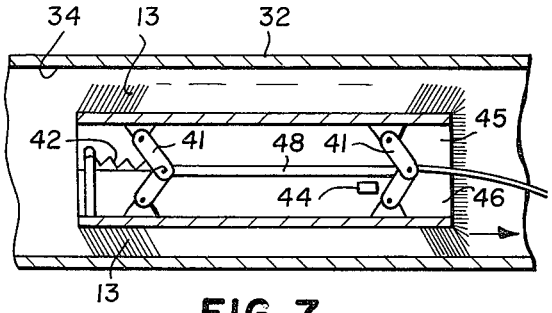

If the inventive cleaner meets an obstruction in a pipe or for some reason cannot advance further, considerable force may be required to withdraw the cleaner rearwardly from the pipe it entered, and to make a rearward withdrawal easier, the inventive cleaner can be made expansible and contractable as shown in FIGS. 6 and 7. This can be done in many ways, but one simple expedient as illustrated uses toggles 41 biased by a spring 42 connected to a fixed rod 43 for normally pulling toggles 41 to a braced overcenter position against stop 44 as shown in FIG. 6. This separates semicylindrical body portions 45 and 46 each carrying pile bristles 13 engaging the inside surface 34 of pipe 32. A retrieval cable 47 is connected to the rearward pair of toggles 41 which are connected by a rod 48 to forward toggles 41, and when retrieval cable 47 is pulled backwards as shown in FIG. 7, both toggles 41 are pivoted backward against the tension of spring 42 for bringing body portions 45 and 46 together to collapse the cleaner and move pile bristles 13 slightly out of engagement with the inside surface 34 of pipe 32 so that the cleaner is easily withdrawn. Body portions 45 and 46 can be made flat to fit two opposite surfaces of a square pipe 12 such as shown in FIGS. 1 and 2 with two passes of the cleaner through a square pipe being required to clean all four interior surfaces of the pipe.

Figure 8:
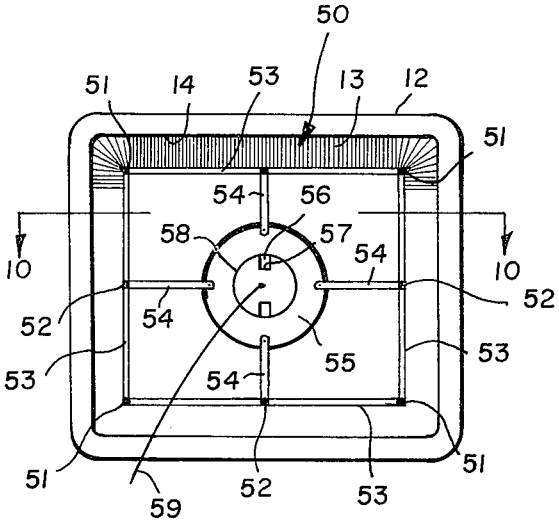
FIGS. 8 and 9 are partially schematic, end-elevational views of another preferred embodiment of the inventive cleaner shown as expanded to operating position in FIG. 8 and collapsed for rearward withdrawal in FIG. 9.
Figure 9:
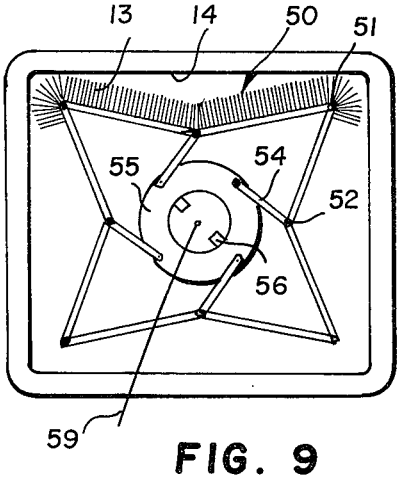
Figure 10:
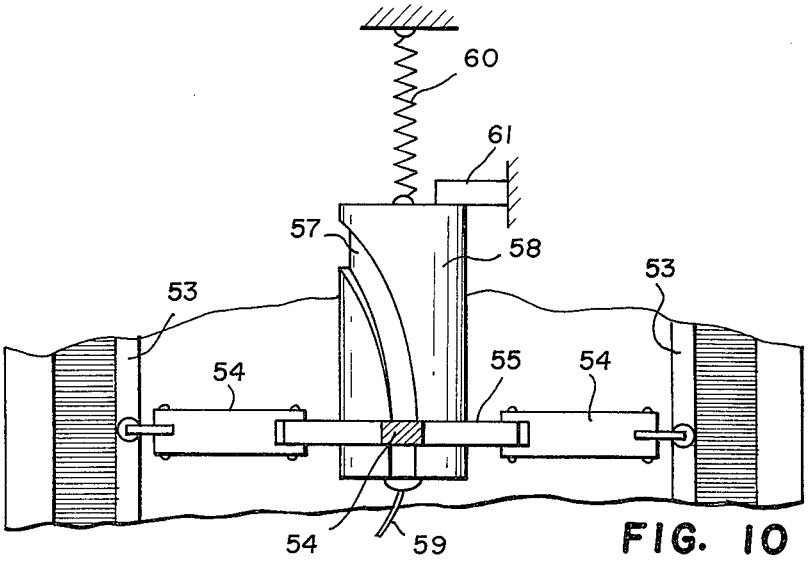
FIG. 10 is an enlarged, fragmentary, cross-sectional view of the cleaner of FIG. 8 taken along the line 10—10 thereof.

Many other expansible and contractable devices can be used for the inventive cleaner, and another form of contractable cleaner 50 is shown in FIGS. 8–10 for fitting in a square pipe 12. Cleaner 50 has axially extending corner hinges and axially extending central wall hinges 52 so that each of the four body walls 53 are hinged along longitudinal mid-regions and at the corners of the cleaner body. Walls 53 carry bristle pile material 13 along their axial extents for engaging the inside surface 14 of pipe 12 and cleaning pipe 12 as cleaner 50 advances.

Connecting rods 54 extend between disk 55 and central wall hinges 52 so that when disk 55 is rotated to the position of FIG. 9, central wall hinges 52 are drawn inward by connecting rods 54 for collapsing cleaner 50 to the illustrated position clear of pipe 12 for easy withdrawal. Rotation of disk 55 is accomplished by cam followers 56 extending into grooves 57 in a cam 58 that is movable axially of cleaner 50 by a retrieval cable 59. Cam 58 is biased forward by a spring 60 to the normally assumed position shown in FIGS. 8 and 10 where cam 58 rests against a stop 61. In such a position, connecting rods 54 are braced in an over-center position to hold walls 53 fully outward so pile bristles 13 can engage the inside surface 14 of pipe 12. When cable 59 is pulled rearwardly, cam 58 is moved axially rearwardly against the bias of spring 60 so that cam grooves 57 turn cam followers 56 on disk 55 to the position shown in FIG. 9 for collapsing cleaner 50 for easy withdrawal.

Other expansible and contractable cleaners using other operating mechanisms can be devised for various shapes of pipe and various operating conditions. The cleaners of FIGS. 6–10 schematically illustrate the expanding and collapsing devices and for simplicity of illustration leave out vibrator devices, spray nozzles, vacuum nozzles, abrasive bristles, and other components that can be used with such cleaners.

The features shown in the drawings and described above can be combined in many different cleaners, and the combinations illustrated are merely to show some of the many combinable possibilities. Those skilled in the art will appreciate the many different vibrators, pile bristles, power supplies, couplings, and other components of the inventive cleaner that can be assembled for various pipe cleaning operations.

I claim:

1. A self-propelled pipe cleaner comprising:

a. a body having an axial extent shaped to conform to the inside of said pipe and to have a predetermined uniform clearance around said inside of said pipe;

b. pile material substantially covering said axial extent of said body and extending outward from said body far enough to engage the inside of said pipe and support said body within said pipe;

c. said pile material having a multitude of resilient resin bristles of uniform length uniformly inclined from a plane transversely perpendicular to said axial extent of said body rearwardly relative to a forward direction of motion of said cleaner;

d. a vibrator mounted within said axial extent of said body; and e. means for energizing said vibrator to vibrate said body reciprocally in the direction of said axial extent of said body so said bristles engaging said inside of said pipe move said cleaner in said forward direction through said pipe for cleaning said pipe.

2. The cleaner of claim 1 wherein said pipe and said axial extent of said body are generally cylindrical and said bristles are inclined relative to the axis of said body for rotating said body as said cleaner advances.

3. The cleaner of claim 1 including a spray nozzle mounted on said body to direct a liquid spray onto said inside of said pipe.

4. The cleaner of claim 3 including a liquid supply outside said pipe and a flexible conduit extending from said liquid supply to said cleaner to conduct said liquid to said nozzle.

5. The cleaner of claim 1 including a vacuum nozzle mounted on said body to be near said inside of said pipe and vacuum means for operating said nozzle to clean said inside of said pipe.

6. The cleaner of claim 5 wherein said vacuum means includes a vacuum source outside said pipe and a flexible conduit extending from said vacuum source to said vacuum nozzle.

7. The cleaner of claim 1 wherein said body is radially collapsible and a cable extending rearwardly of said cleaner is operable for collapsing said body for rearwardly withdrawing said body from said pipe.

* * * * *